US005432883A

United States Patent [19]

Yoshihara

[11] Patent Number: 5,432,883

[45] Date of Patent: Jul. 11, 1995

[54] VOICE CODING APPARATUS WITH SYNTHESIZED SPEECH LPC CODE BOOK

[75] Inventor: Takafumi Yoshihara, Tokyo, Japan

[73] Assignee: Olympus Optical Co., Ltd., Tokyo, Japan

[21] Appl. No.: 52,658

[22] Filed: Apr. 26, 1993

[30] Foreign Application Priority Data

Apr. 24, 1992 [JP] Japan ..... 4-106727
Sep. 1, 1992 [JP] Japan ..... 4-233925

[51] Int. Cl.[6] ..... G10L 3/02

[52] U.S. Cl. ..... 395/2.28; 395/2; 395/2.1; 395/2.67; 395/2.71; 381/36

[58] Field of Search ..... 381/36; 395/2.11, 2, 395/2.1, 2.28, 2.67, 2.71

[56] References Cited

U.S. PATENT DOCUMENTS 5,208,862 5/1993 Ozawa ..... 381/36

FOREIGN PATENT DOCUMENTS 443548 8/1991 European Pat. Off. ..... G10L 9/14
3-243998 10/1991 Japan ..... G10L 9/14
4-1800 1/1992 Japan ..... G10L 9/14
4-73700 3/1992 Japan ..... G10L 9/14

OTHER PUBLICATIONS

Indrayanto et al., "A Neural Network Mapper for Stochastic Code Book Parameter Encoding in Code—Excited Linear Predictive Speech Processing," IEEE/-Wescanex 1991, pp. 221–224.

JPOABS Search Abstract: Abstracts of Japan, Okashita Application #: 01–126314, Mar. 4, 1991, vol. 15, #88.

"Improved Speech Quality and Efficient Vector Quantization in Selp", W. B. Kleijin, et al., International Conference on Acoustics, Speech, and Signal Processing (ICASSP), 1988, IEEE, vol. 1, Speech Processing, Catalog No. 88CH2561–9, New York, N.Y., U.S.A., pp. 155–158.

*Primary Examiner*—Allen R. MacDonald
*Assistant Examiner*—Tariq Hafiz
*Attorney, Agent, or Firm*—Frishauf, Holtz, Goodman & Woodward

[57] ABSTRACT

A voice coding apparatus has a first linear prediction analyzer for acquiring linear prediction coefficients based on a received input speech sampled at a given time interval. A synthesized speech LPC code book stores linear prediction coefficients of a speech resynthesized based on an old input speech. An excitation code book has predetermined excitation vectors. A first error minimizer receives a signal representing an error between the linear prediction coefficient from the first linear prediction analyzer and one linear prediction coefficient of the synthesized speech LPC code book and acquires an index of the synthesized speech LPC code book which minimizes the error. A linear predictor computes a predictive speech based on the index, acquired by the first error minimizer, and an excitation vector of the excitation code book. A second error minimizer receives a signal representing an error between the input speech and the predictive speech from the linear predictor, and acquires the predictive speech that minimizes the error and an index of the excitation code book at that time while scanning indexes of the excitation code book. A second linear prediction analyzer converts the predictive speech from the second error minimizer into a linear prediction coefficient again and supplies the converted linear prediction coefficient to the synthesized speech LPC code book.

13 Claims, 12 Drawing Sheets

VOICE CODING APPARATUS WITH SYNTHESIZED SPEECH LPC CODE BOOK

BACKGROUND OF THE INVENTION

1. Field of the Invention

The present invention relates to a voice coding apparatus which employs an analysis-by-synthesis coding technique that is one of voice coding techniques for efficiently coding a human speech.

2. Description of the Related Art

CELP (Code-Excited Linear Prediction) coding which uses linear prediction and an excitation code book is a typical analysis-by-synthesis coding technique. FIG. 13 illustrates the structure of a voice coding apparatus which uses this coding technique. In the diagram, an input speech x input to a speech input section 1 is supplied to a linear predictive analyzer 2 to acquire a linear prediction coefficient $\alpha$. The coefficient $\alpha$, subjected to scalar quantization in a linear prediction coefficient quantizer 3, is supplied to a linear predictor 4. The linear predictor 4 receives an index $i_e$ of an excitation vector from the excitation code book 5 and outputs a linear predictive speech $x_v$. A subtracter 8 obtains the difference between the input speech x and the linear predictive speech $x_v$ to acquire a predictive error e. This predictive error e is supplied via an aural weighting filter 6 to an error minimizer 7 to reduce the aural noise. The error minimizer 7 obtains the mean square error of the predictive error e, and holds the minimum mean square error and the index $i_e$ of the excitation vector at the time of this error. After the above processing is performed for every excitation vector in the excitation code book 5, the quantized linear prediction coefficient a and the index $i_e$ of the excitation vector are sent to a voice decoding apparatus.

The conventional voice coding apparatus could not minimize the linear predictive error sufficiently even when an adaptive code book that uses the correlation of the linear predictive errors between the adjoining frames is used.

SUMMARY OF THE INVENTION

It is therefore an object of the present invention to provide a voice coding apparatus which uses the a resynthesized speech and its correlation of the linear prediction coefficients between adjoining frames to reduce the linear predictive error and ensure a lower bit rate of codes.

To achieve this object, according to this invention, there is provided a voice coding apparatus comprising:

first linear prediction analyzing means for acquiring linear prediction coefficients based on a received input speech sampled at a given time interval;

a synthesized speech LPC code book for storing linear prediction coefficients of a speech resynthesized based on an old input speech;

an excitation code book having predetermined excitation vectors;

first error minimizing means for receiving a signal representing an error between the linear prediction coefficient from the first linear prediction analyzing means and one linear prediction coefficient of the synthesized speech LPC code book and acquires an index of the synthesized speech LPC code book which minimizes the error;

linear predicting means for computing a predictive speech based on the index, acquired by the first error minimizing means, and an excitation vector of the excitation code book;

second error minimizing means for receiving a signal representing an error between the input speech and the predictive speech from the linear predicting means, and acquires the predictive speech that minimizes the error and an index of the excitation code book at that time while scanning indexes of the excitation code book; and second linear prediction analyzing means for converting the predictive speech from the second error minimizing means into a linear prediction coefficient again and supplying the converted linear prediction coefficient to the synthesized speech LPC code book.

According to this invention, there is provided a voice decoding apparatus comprising:

a synthesized speech LPC code book for receiving an index of a synthesized speech LPC code book on a coding side and outputting an associated linear prediction coefficient;

an excitation code book for receiving an index of an excitation code book on the coding side and outputting an associated excitation vector;

linear predicting means for generating a synthesized speech based on the linear prediction coefficient output from the synthesized speech LPC code book and the excitation vector output from the excitation code book; and linear prediction analyzing means for acquiring a new linear prediction coefficient from the synthesized speech generated by the linear predicting means and supplying the new linear prediction coefficient to the synthesized speech LPC code book.

According to this invention, there is provided a voice coding and decoding apparatus comprising coding means and decoding means, the coding means including:

first linear prediction analyzing means for acquiring linear prediction coefficients based on a received input speech sampled at a given time interval;

a synthesized speech LPC code book for storing linear prediction coefficients of a speech resynthesized based on an old input speech;

an excitation code book having predetermined excitation vectors;

first error minimizing means for receiving a signal representing an error between the linear prediction coefficient from the first linear prediction analyzing means and one linear prediction coefficient of the synthesized speech LPC code book and acquires an index of the synthesized speech LPC code book which minimizes the error;

linear predicting means for computing a predictive speech based on the index, acquired by the first error minimizing means, and an excitation vector of the excitation code book;

second error minimizing means for receiving a signal representing an error between the input speech and the predictive speech from the linear predicting means, and acquires the predictive speech that minimizes the error and an index of the excitation code book at that time while scanning indexes of the excitation code book; and second linear prediction analyzing means for converting the predictive speech from the second error minimizing means into a linear prediction coefficient again and supplying the converted linear prediction coefficient to the synthesized speech LPC code book;

the decoding means including:

a synthesized speech LPC code book for receiving an index of a synthesized speech LPC code book on a coding side and outputting an associated linear prediction coefficient;

an excitation code book for receiving an index of an excitation code book on the coding side and outputting an associated excitation vector;

linear predicting means for generating a synthesized speech based on the linear prediction coefficient output from the synthesized speech LPC code book and the excitation vector output from the excitation code book; and linear prediction analyzing means for acquiring a new linear prediction coefficient from the synthesized speech generated by the linear predicting means and supplying the new linear prediction coefficient to the synthesized speech LPC code book.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Preferred embodiments of the present invention will now be described referring to the accompanying drawings.

Figure 1:
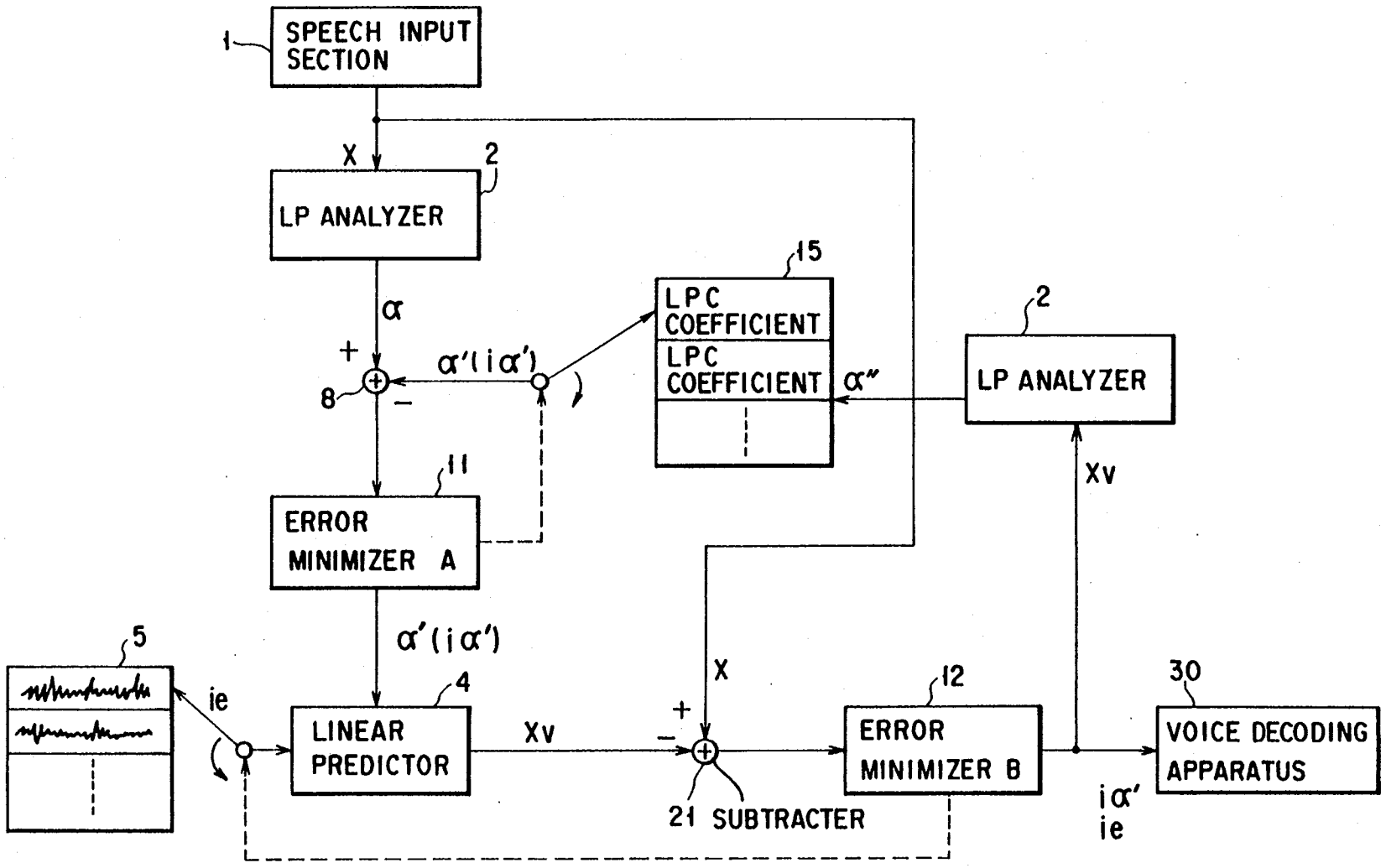
FIG. 1 is a diagram illustrating the structure of a voice coding apparatus according to a first embodiment of the present invention.

FIG. 1 illustrates the structure of a voice coding apparatus according to a first embodiment of the present invention. The feature of the first embodiment over the conventional voice coding apparatus lies in the additional provision of a synthesized speech LPC (Linear Prediction Coefficient) code book 15 for storing linear prediction (LP) coefficients of a synthesized speech $x_v$ which has been resynthesized based on an old input speech. That is, the synthesized speech $x_v$ is subjected again to linear prediction analysis in a linear prediction (LP) analyzer 2 to acquire an LP coefficient $\alpha$, which is input to the synthesized speech LPC code book 15 for later use as a code book.

The specific operation of the above structure will be described below.

First, an input speech x, which has been sampled at a given time interval and supplied to a speech input section 1, is sent to the LP analyzer 2 to obtain an LP coefficient $\alpha$. This LP coefficient $\alpha$ is compared with one element in the synthesized speech LPC code book 15 and the result is sent to an error minimizer All. The error minimizer All scans indexes of the synthesized speech LPC code book 15 to obtain an index $i\alpha'$ of the synthesized speech LPC code book 15 which minimizes an error. A linear predictor 4 computes a predictive speech $x_v$ using an element (LP coefficient $\alpha'$) indicated by the index $i\alpha'$ and an excitation vector, an element of an excitation code book 5, and outputs it.

Then, an error minimizer B12 receives the difference or error between the input speech x and its predictive speech $x_v$, obtained by a subtracter 21, and scans indexes of the excitation code book 5 to obtain that predictive speech $x_v$ which minimizes the error, and an index $i_e$ of the excitation code book 5 at that time. The index $i\alpha'$ of the synthesized speech LPC code book 15 and the index $i_e$ of the excitation code book 5 are sent to a voice decoding apparatus 30. The predictive speech $x_v$ for the minimum error is sent from the error minimizer B12 to the LP analyzer 2 to be converted into an LP coefficient $\alpha''$ again, and this coefficient $\alpha''$ is registered as a new element of the synthesized speech LPC code book 15.

A second embodiment of the present invention will now be described.

when an LP coefficient is obtained by the LP analyzer 2, a carry drop may occur during the computation, thus lowering the accuracy of the LP coefficient. This embodiment prevents this shortcoming. To begin with, the outline of this embodiment will be described.

A linear predictive (LP) value is expressed by an LP coefficient $\alpha i$ and an old sampled value xt-i from the following equation (1).

$$\hat{x}t = -\sum_{i=1}^{p} \alpha i \cdot xt - i \tag{1}$$

where $\hat{x}t$ is an LP value, $\alpha i$ is a LP coefficient and p is an analysis order.

A predictive error et is expressed by the following equation (2).

$$et = xt - \hat{x}t \tag{2}$$

Figure 2:
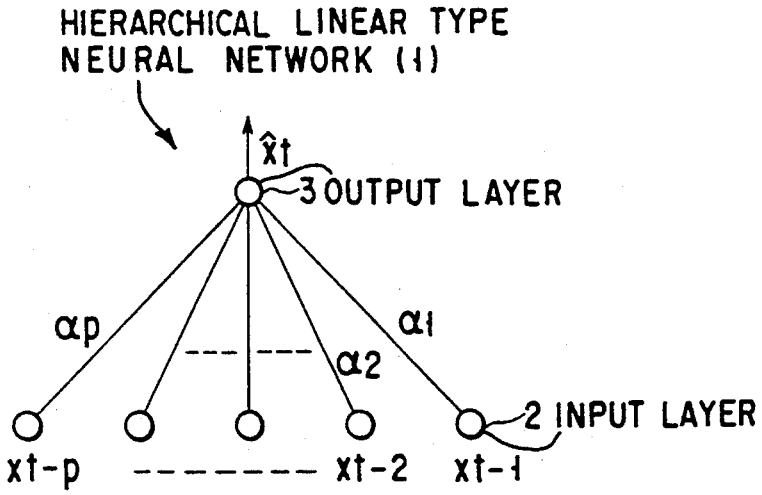
FIG. 2 is a diagram showing the structure of a double-layer hierarchical linear type neural network.

Let us consider a double-layer hierarchical neural network 1 as shown in FIG. 2. Then, the old sampled value xt-i can be seen as an input value to each neuron unit of an input layer 2, the LP coefficient $\alpha'$ as a synapse coupling coefficient between the input and output layers 2 and 3, and the LP value as the output value of a neuron unit of the output layer 3.

Using the sampled value xt at the present point of time as a teaching signal, learning of the synapse coupling coefficient or the LP coefficient $\alpha i$ is executed to minimize the square of the predictive error et.

In the hierarchical linear type neural network 1 shown in FIG. 2, when the old sampled values xt-i for the order of the LP analysis are input to the input layer 2, the sum of products of the sampled values xt-i and synapse coupling coefficients corresponding to LP coefficients is performed to acquire an LP value. With regard to the learning, the error E can be defined as the following equation (3)

$$E = 1/2 \cdot \sum_{t=1}^{T} (xt - \hat{x}t)^2 \quad (3)$$

Then, a technique called back propagation learning as expressed by an equation (4) below is employed.

$$\Delta \alpha i \propto -\partial E/\partial \alpha i \quad (4)$$

Figure 3:
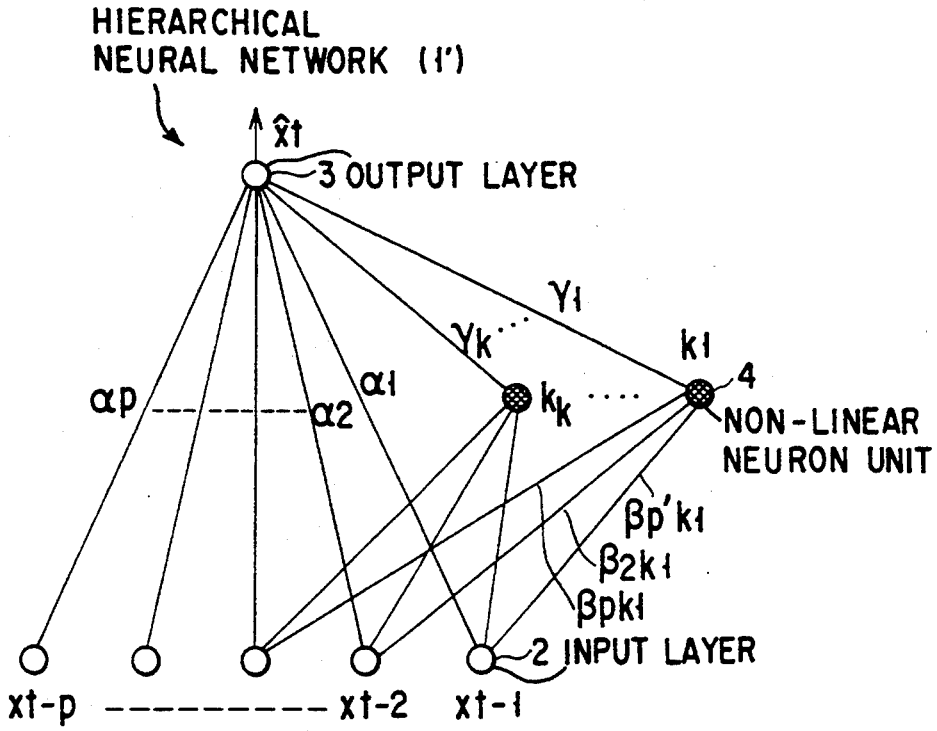
FIG. 3 is a diagram illustrating non-linear neuron units 4 added between input and output of the hierarchical linear type neural network 1 shown in FIG. 2.

FIG. 3 illustrates non-linear neuron units 4 added between input and output of the hierarchical linear type neural network 1 shown in FIG. 2 to ensure prediction of the characteristic of that speech which is non-linear by nature and is thus difficult to predict by linear prediction alone.

The illustrated non-linear neuron unit 4 converts the sum of product of the input value from the input layer 2 and the synapse coupling coefficient with a nonlinear function f(x) and outputs the result.

At this time, the output value $Y_{tk}$ of a non-linear neuron unit k is expressed by an equation (5) below.

$$Ytk = f\left(\sum_{i=1}^{P} Bik \cdot xt - i\right) \quad (5)$$

It is to be noted that the back propagation learning is employed as mentioned above, using a sigmoid function like $f(x)=1/(1+\exp(-x))$. P' is the number of synapse couplings between the neuron units and nonlinear neuron units of the input layer.

The following is a description of the second embodiment based on the above-described principle.

Figure 4:
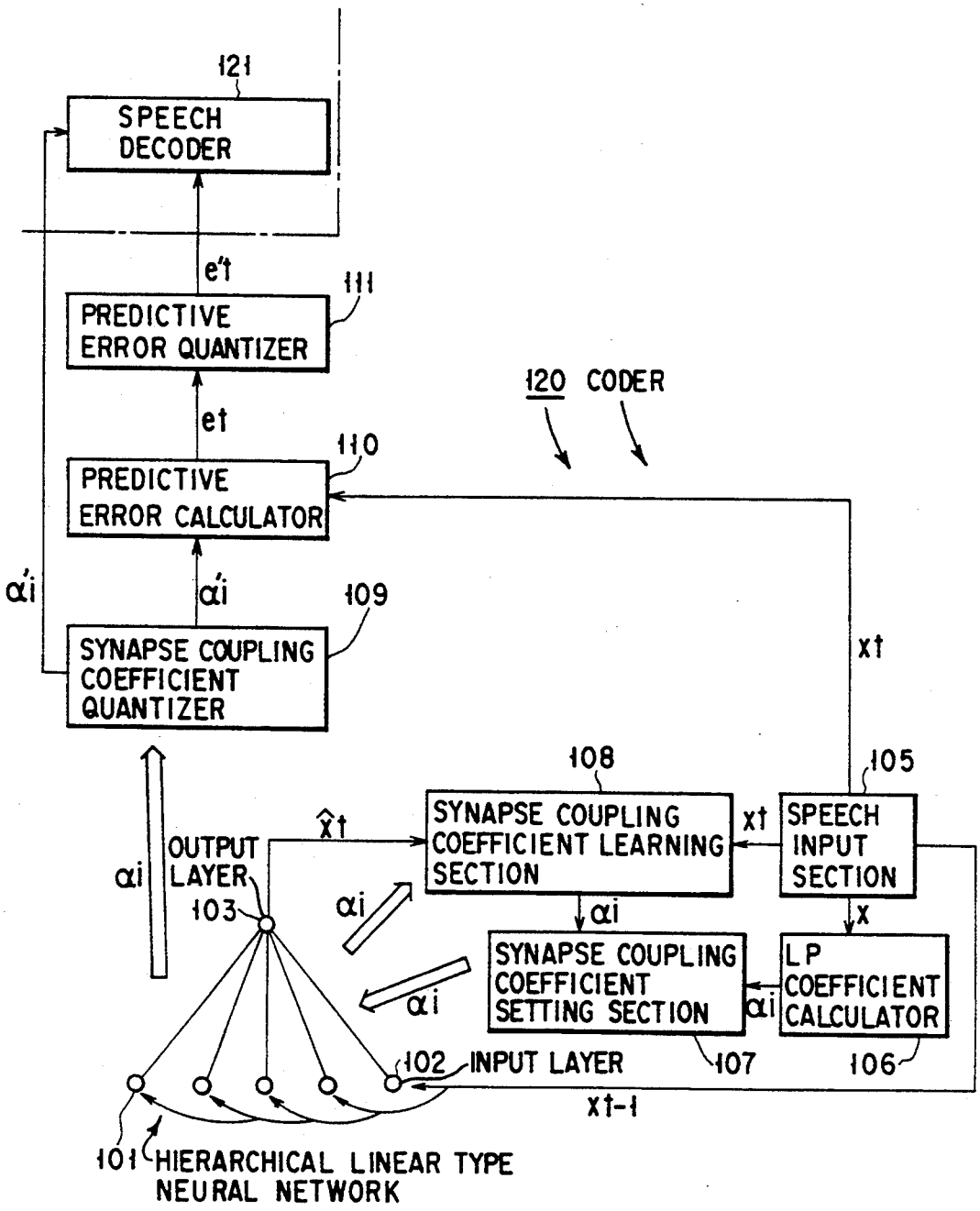
FIG. 4 is a diagram illustrating the structure of a second embodiment of this invention.

FIG. 4 illustrates the structure of the second embodiment of this invention.

As illustrated, in a coder 120, a speech input section 105 is connected to an input layer 102 of a double-layer hierarchical linear type neural network 101 and an output layer 103 of the neural network 101 is connected to a synapse coupling coefficient learning section 108. The speech input section 105 is further connected to an LP coefficient calculator 106, the synapse coupling coefficient learning section 108 and a predictive error calculator 110. The calculator 106 acquires LP coefficients for the analysis order from the input speech. The learning section 108 performs a learning operation for synapse coupling coefficients through the back propagation learning. The predictive error calculator 110 acquires the predictive error et.

The LP coefficient calculator 106 and synapse coupling coefficient learning section 108 are connected to a synapse coupling coefficient setting section 107, which is also connected to the neural network 101. This neural network 101 is connected to a synapse coupling coefficient quantizer 109 which quantizes the synapse coupling coefficients. The quantizer 109 is further connected to the predictive error calculator 110 and a voice decoder 121. The voice decoder 121 synthesizes a speech waveform based on the quantized data of both the synapse coupling coefficients associated with the input speech and the predictive error.

The predictive error calculator 110 is connected to a predictive error quantizer 111 which quantizes the predictive error. This quantizer 111 is also connected to the voice decoder 121.

With the above structure, when a predetermined number of speeches sampled at given time intervals are input from the speech input section 105 to the LP coefficient calculator 106, LP coefficients for the analysis order are computed by a well-known covariance method or auto-correlation method.

Normally, the analysis order P is about 10. The result of the computation is supplied to the synapse coupling coefficient setting section 107 to be set as an initial value of the LP coefficient $\alpha'$ of the neural network 101.

When the initial value is set, the neural network 101 is activated while inputting the input values xt-i for the analysis order P and the LP value of the current speech waveform is output to the synapse coupling coefficient learning section 108.

This learning section 108 updates and learns the synapse coupling coefficient $\alpha i$ through the back propagation learning, using the LP value, the synapse coupling coefficient $\alpha i$, the current sampled value xt and the input value xt-i to the input layer 102. The renewed synapse coupling coefficient $\alpha i$ is supplied to the synapse coupling coefficient setting section 107 to be set as a new synapse coupling coefficient for the neural network 101.

Although the back propagation learning is executed until the decrease in error E stops, this learning may be executed until the predictive error et falls within a threshold value when and only when the predictive error et is equal to or above the threshold value. This modification can eliminate the conventional process of extracting the pitch as sound source information from the predictive error.

If the back propagation learning is executed when and only when the predictive error et is equal to or below the threshold value, the predictive error may be turned into a pulse, i.e., power concentration may occur, ensuring efficient coding.

Although the pitch component generally remains as a cyclic impulse in the predictive error, this error can be removed effectively by the threshold-value involved process. Further, as the predictive error is set equal to or below the threshold value, the dynamic range is narrowed, thus contributing to the reduction of the amount of codes.

When the back propagation learning is completed, the synapse coupling coefficient quantizer 109 reads the synapse coupling coefficient of the neural network 101 and quantizes it with a predetermined number of quantization bits.

The predictive error calculator 110 computes the predictive error et between the predictive value obtainable from the quantized synapse coupling coefficient and the current sampled value xt. The predictive error quantizer 111 quantizes the computed predictive error.

The quantized data of the synapse coupling coefficient and predictive error are supplied to the voice decoder 121 for speech synthesis.

Figure 5:
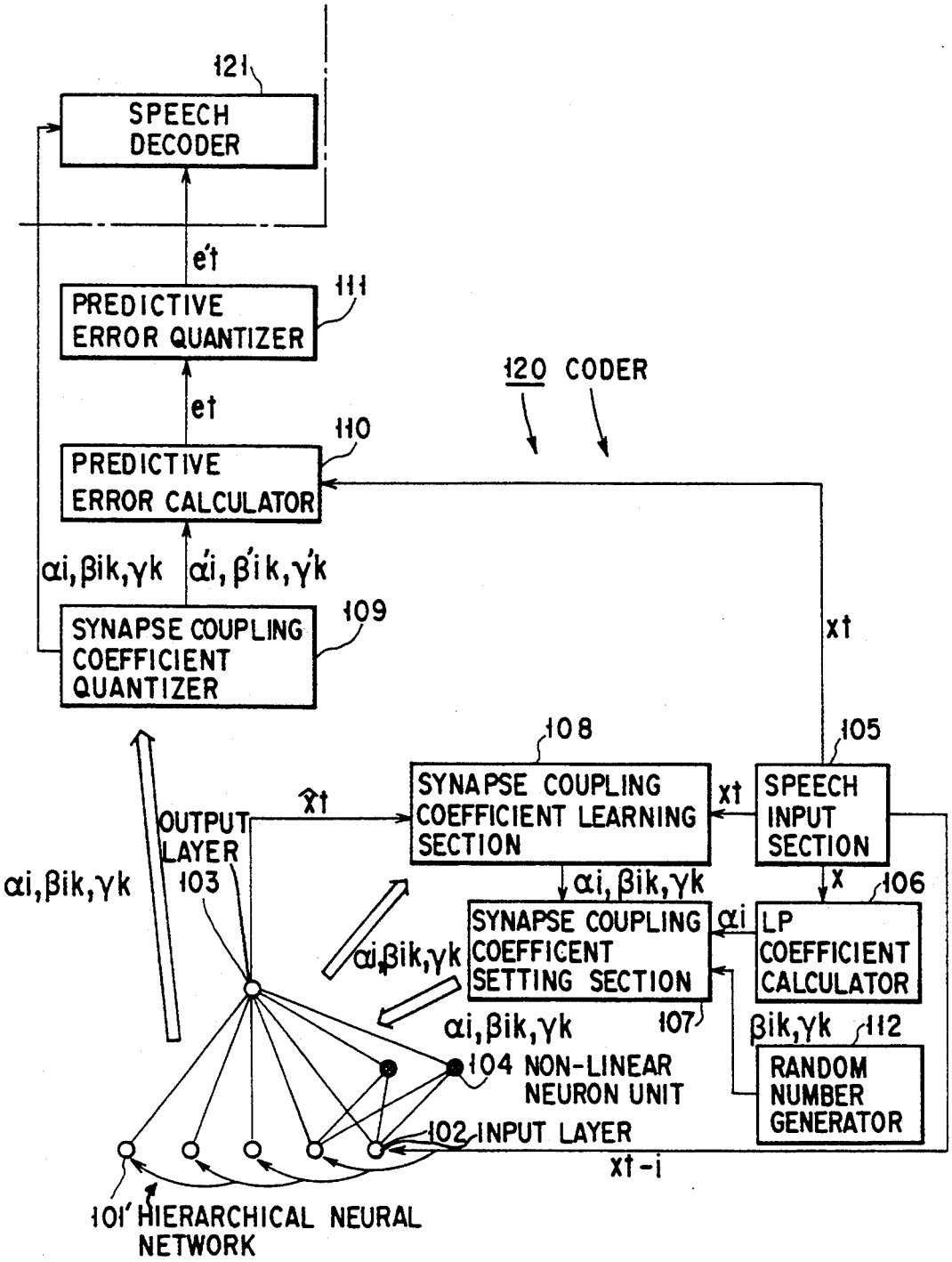
FIG. 5 is a diagram showing a modification of the second embodiment of this invention.
Figure 6:
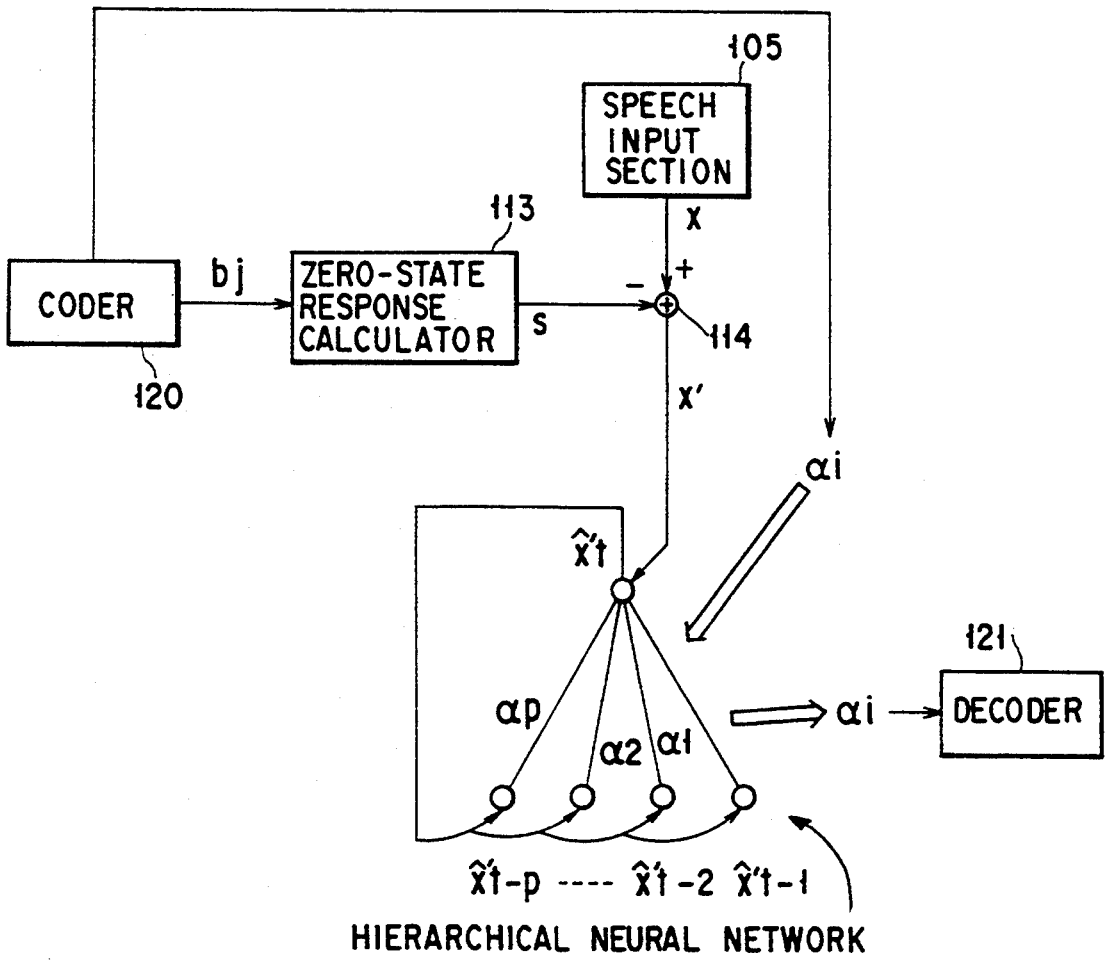
FIG. 6 is a diagram for explaining the outline of a voice coding apparatus which employs a CELP coding scheme.

FIG. 5 shows a modification of the second embodiment of this invention.

This modification is characterized in that a random number generator 112 is additionally provided to the second embodiment with non-linear neuron units 104 provided between the input and output layers of the hierarchical linear type neural network 101.

With this structure, when receiving the initial value of the synapse coupling coefficient $\alpha i$ from the LP coefficient calculator 106 and small random numbers as the initial values of a synapse coupling coefficient $\beta ik$ between the input layer and non-linear neuron unit and a synapse coupling coefficient $\gamma k$ between the non-linear neuron unit and output layer at the same time, the synapse coupling coefficient setting section 107 sets those values to the neural network 101'.

When the initial values are set, this modification performs the same processing as done in the first embodiment. The predictive value of the current speech waveform is expressed by an equation (6) below.

$$\hat{x}t = -\left(\sum_{i=1}^{P} \alpha i \cdot xt - i + \sum_{k=1}^{K} \gamma k \cdot f\left(\sum_{j=1}^{J} \beta jk \cdot xt - j\right)\right) \quad (6)$$

where K is the number of the non-linear neuron units, J is the number of synapse couplings from the input layer neuron unit to each non-linear neuron unit and $P \geqq J$.

According to this embodiment, the additional provision of the non-linear neuron units 104 can ensure non-linear prediction of a speech waveform and can further reduce the predictive error.

To prevent the LP coefficient $\alpha i$ from greatly varying at the beginning of the learning, only the coefficients $\beta ik$ and $\gamma k$ associated with the non-linear neuron units may be updated with $\alpha i$ fixed at the beginning of the learning, and the all the synapse coupling coefficients may be learned and updated in the next stage.

The foregoing description has been given with reference to the case where this embodiment is adapted for linear prediction analysis. A description will now be given of the case where this embodiment is adapted for CELP coding using linear prediction analysis.

First, the outline of a voice coding apparatus which is the second embodiment that employs the CELP coding.

As illustrated, the coder 120 is connected to a zero-state response calculator 113, and this calculator 113 and the speech input section 105 are connected via a subtracter 114 to the hierarchical neural network 101. The coder 120 is further connected to the neural network 101, which is further connected to the decoder 121.

With the above structure, an optimal excitation vector bj output from the coder 120 is supplied to the zero-state response calculator 113, which computes and outputs a zero-state response St. The zero-state response St can be expressed as an equation (7) below using the LP coefficient $\alpha i$ and excitation vector bj as in the linear predictor.

$$St = -\sum_{i=1}^{P} \alpha i \cdot St - i + bjt \quad (7)$$

It should however be noted that the difference from the computation in the linear predictor lies in that the values of the St-i in the initial state are all zeros in the computation. The subtracter 14 obtains the difference $x'(=x-s)$ between the input speech x and the zero-state response of the excitation vector bj and sends it to the neural network 101.

This hierarchical neural network 101 is of a double-layer linear type having the input layer 102 and output layer 103 coupled by synapses. The LP coefficient $\alpha i$ acquired by the coder 120 is used as the initial value of the synapse coupling coefficient of the neural network 101.

When an old output value xt-i is input to the input layer 102 of the neural network 101, the error E is computed from, for example, an equation (8) and the back propagation learning illustrated in the aforementioned equation (4) is executed to minimize this error E.

$$E = 1/2 \cdot \sum_{t=1}^{T} (x't - \hat{x}'t)^2 + 1/2 \cdot \sum_{i=1}^{P} \sum_{m=1}^{M} (\alpha i - Vim)^2/\{(\alpha i - Vim)^2 + \epsilon\} \quad (8)$$

In the equation (8), the first term is a normal output-error minimizing term with the output value x' from the subtracter 114 as teaching data, while the second term provides a value that becomes smaller as the LP coefficient $\alpha i$ approaches to any element Vim in a quantizing table vi. Here, $\epsilon$ is a positive constant close to "0."

While sequential back propagation learning to update the synapse coupling coefficient per speech signal x't, a collective type to collectively update synapse coupling coefficients per analysis frame is used in this embodiment so that every time the synapse coupling coefficients are updated, the LP coefficient $\alpha i$ of the zero-state response calculator is updated with the synapse coupling coefficient $\alpha i$ of the neural network 101.

The recalculation of the zero-state response is repeated until the error E becomes sufficiently small, and when the error E becomes such, the synapse coupling coefficient $\alpha i$ is quantized to be output as a more optimal LP coefficient.

Figure 7:
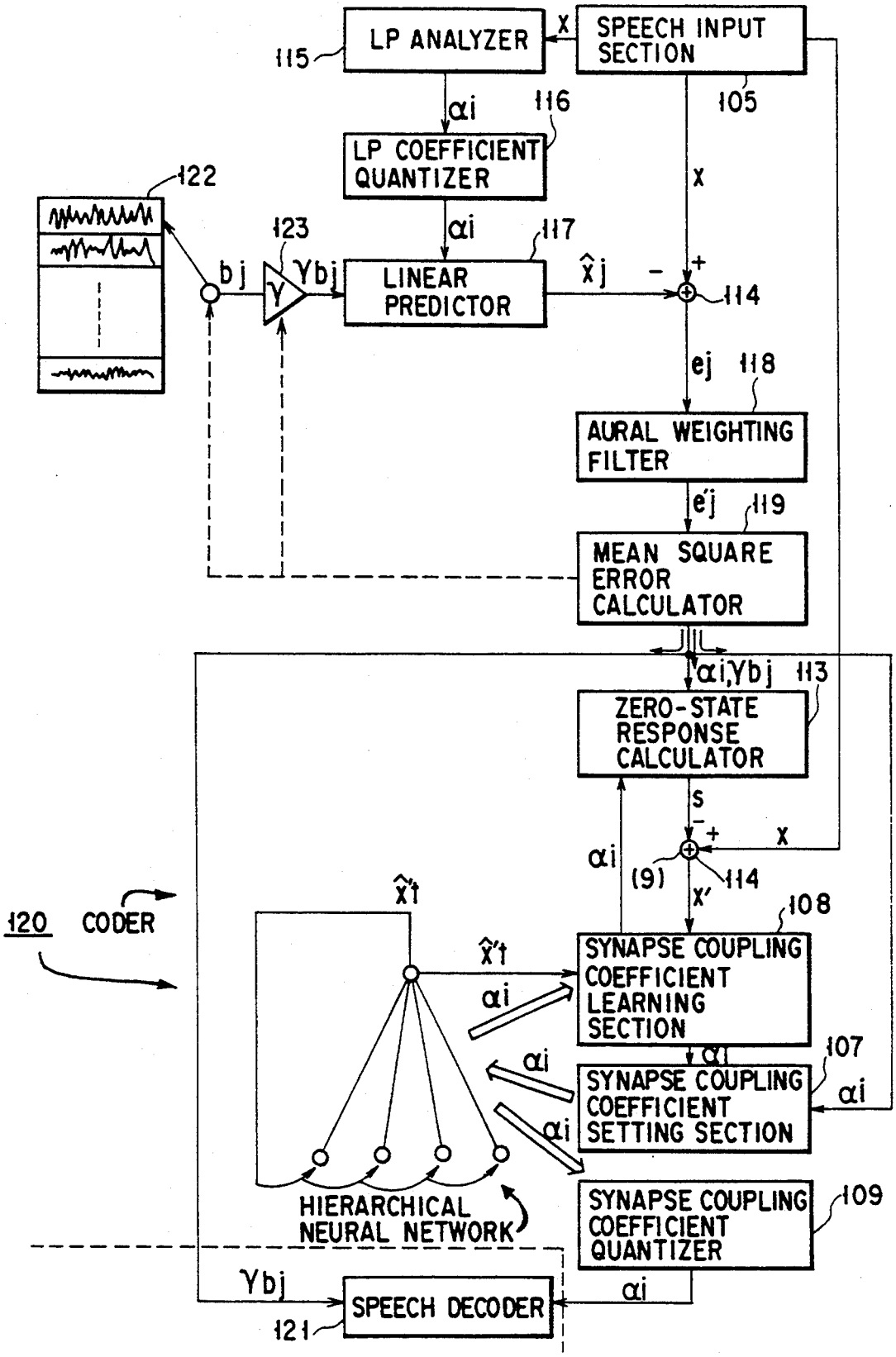
FIG. 7 is a diagram showing another modification of the second embodiment of this invention.

FIG. 7 shows a modification of the above-described second embodiment.

As illustrated, the speech input section 105 is connected to the LP analyzer 115, which is connected to the LP coefficient quantizer 116. This quantizer 116 further connected to the linear predictor 117 to which a gain adder 123 for giving a gain $\gamma$ to the excitation vector b122 is added.

Further, the speech input section 105 and linear predictor 117 are connected via a subtracter **114*a* to an aural weighting filter 118. This filter 118 is connected to a mean square error calculator 119, which is connected to the synapse coupling coefficient setting section 107 and zero-state response calculator 113**.

This calculator 113 and speech input section 105 are connected via a subtracter **114*b* to the synapse coupling coefficient learning section 108, which is connected to the synapse coupling coefficient setting section 107**.

The setting section 107 is coupled to the neural network 101, which is also connected to the synapse coupling coefficient learning section 108 and the synapse coupling coefficient quantizer 109. The quantizer 109 is connected to the voice decoder 121 connected to the mean square error calculator 119.

With the above structure, when a predetermined number of speeches sampled at given time intervals are input to the LP analyzer 115, LP coefficients for the analysis order are computed by a well-known covariance method or self-correlation method. Normally, the analysis order P is about 10.

The result of this computation is supplied to the LP coefficient quantizer 116, which subjects the input data to scalar quantization referring to a quantizing table (not shown) and supplies the quantized data to the linear predictor 117.

At the same time, the excitation vector bj from the code book 122 is supplied to the linear predictor 117 after being multiplied by $\gamma$ by the grain adder 123, to thereby acquire an LP speech. Then, the difference between the input speech and the LP speech or the predictive error ej is supplied to the aural weighting filter 118 to reduce noise based on human aural characteristics. The filter output is sent to the mean square error calculator 119, which computes a mean square error and holds the minimum means square error and the excitation vector $\gamma$bj at that time.

This operation is executed for every excitation vector of the code book 122, and the excitation vector $\gamma$bj for the minimum error, resulting from that operation, and the LP coefficient $\alpha$i are supplied to the zero-state response calculator 113.

In this modification, a response value by the excitation vector $\gamma$bj alone, i.e., the zero-state response S is computed, and the difference x' between the input speech and this zero-state S is supplied as teaching data of the neural network 101 to the synapse coupling coefficient learning section 108.

The LP coefficient $\alpha$i from the mean square error calculator 119 is set as the initial value of the synapse coupling coefficient for the neural network 101 through the synapse coupling coefficient setting section 107.

While activating the neural network 107 based on the equation (1), the back propagation learning is executed in the synapse coupling coefficient learning section 108. An equation to minimize the error is defined as, for example, the equation (8). This computation minimizes the error, expressed by the following equation (9), while allowing the LP coefficient $\alpha$i to approach one element Vim in the LP coefficient quantizing table (not shown).

$$x't - \hat{x}'t \tag{9}$$

In other words, the scalar quantization of the LP coefficient and the minimization of the output error are optimized at the same time. The back propagation learning employed in this modification is a collective learning type which collectively updates synapse coupling coefficients per analysis frame so that every time the synapse coupling coefficients are updated, the LP coefficient $\alpha$i of the zero-state response calculator 113 is updated.

After learning of the neural network 101 is repeated through the synapse coupling coefficient setting section 107 until the error E becomes sufficiently small, the synapse coupling coefficient is subjected to scalar quantization in the quantizer 109 before being output to the voice decoder 121.

This voice decoder 121 also receives the optimal excitation vector $\gamma$bj from the mean square error calculator 119 at the same time to synthesizes the speech.

Figure 8:
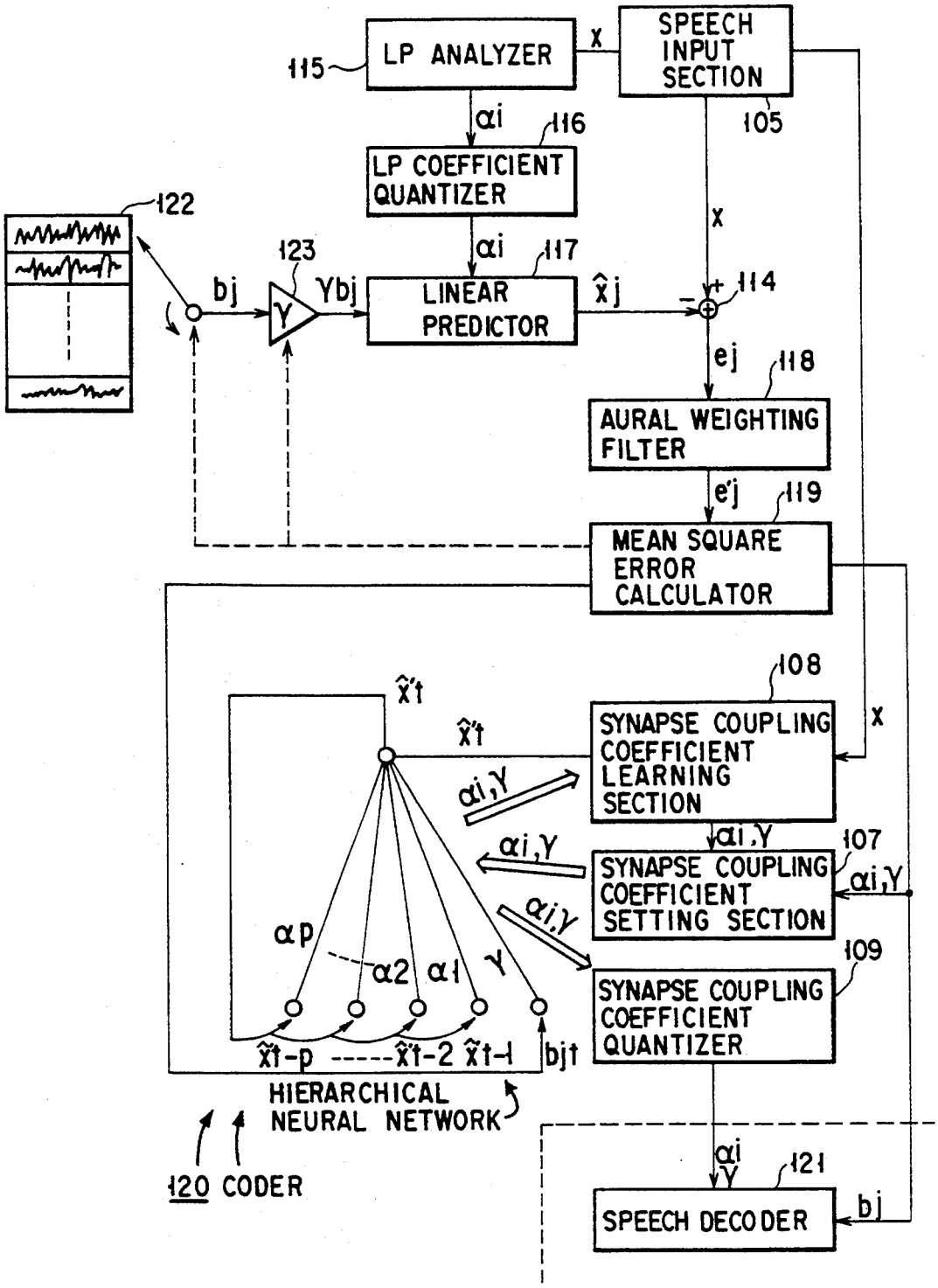
FIG. 8 is a diagram showing a further modification of the second embodiment of this invention.

FIG. 8 shows a further modification of the second embodiment.

As illustrated, the feature of this modification lies in that the zero-state response calculator 113 is eliminated from the structure of the above-described second embodiment, input units for excitation vectors bjt are added instead to the hierarchical neural network 101, and a gain $\gamma$ is set as the initial synapse coupling coefficient.

With the above structure, the gain $\gamma$ of the excitation vector bj from the mean square error calculator 119 is initialized in the neural network 101 via the synapse coupling coefficient setting section 107.

When an element bjt of the excitation vector bj at time t is input to the neural network 101, the learning operation starts. Like the LP coefficient $\alpha$, the gain $\gamma$ is learned in such a way that it approaches to an element in the quantizing table or quantizing step (not shown). That is, an equation (10) below is added to the aforementioned equation that expresses the error E.

$$1/2 \cdot \sum_{n=1}^{N} (\gamma - Un)^2/\{(\gamma - Un)^2 + \epsilon\} \tag{10}$$

where Un is one element of the quantizing table U of the gain $\gamma$ and n is the number of elements in that table.

The voice coder 121 receives the optimal LP coefficient $\alpha$i and the gain $\gamma$ of the excitation vector from the synapse coupling coefficient quantizer 109 to synthesize the speech.

Figure 9:
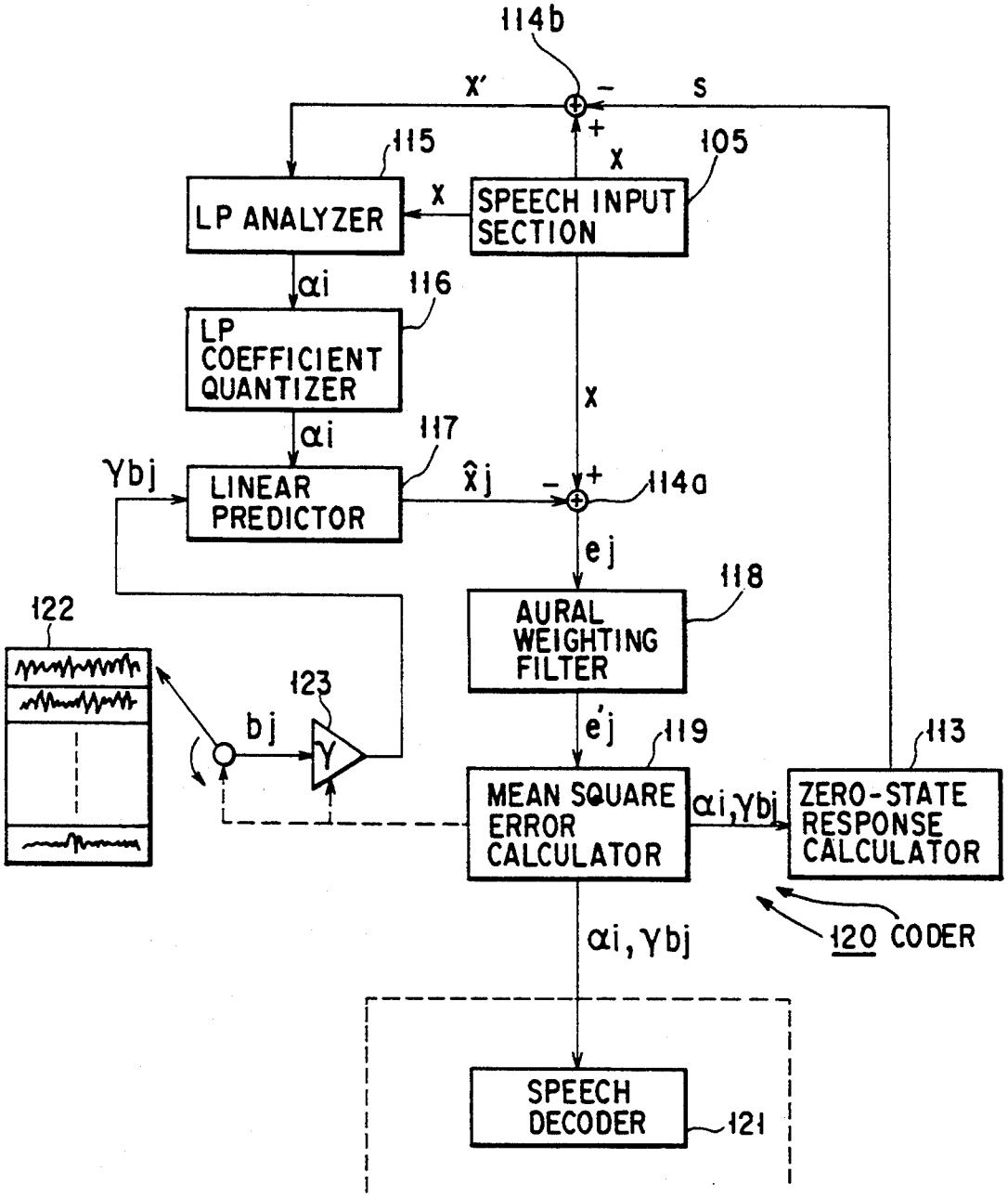
FIG. 9 is a diagram showing a still further modification of the second embodiment of this invention.

FIG. 9 shows a still further modification of the second embodiment.

The feature of this modification over the prior art lies in that the zero-state response calculator 113 is provided so as to feed back the quantized error by the code book 122 to the linear predictor 115.

With this structure, when the optimal excitation vector $\gamma$bj is obtained in the mean square error calculator 119, it is sent to the zero-state response calculator 113 for computation of the zero-state response S for that vector $\gamma$bj, and a new LP coefficient $\alpha$i is obtained in the LP analyzer 115 based on the difference x' between the input speech x and the zero-state response S.

Although it is possible to immediately send the quantized data of this LP coefficient to the voice coder 121, the optimal excitation vector is obtained again to improve the coding precision. The above processing is repeated until the quantized data of the LP coefficient does not vary any more. The LP coefficient and excitation vector can both be optimized in this embodiment through the above operation.

Figure 10:
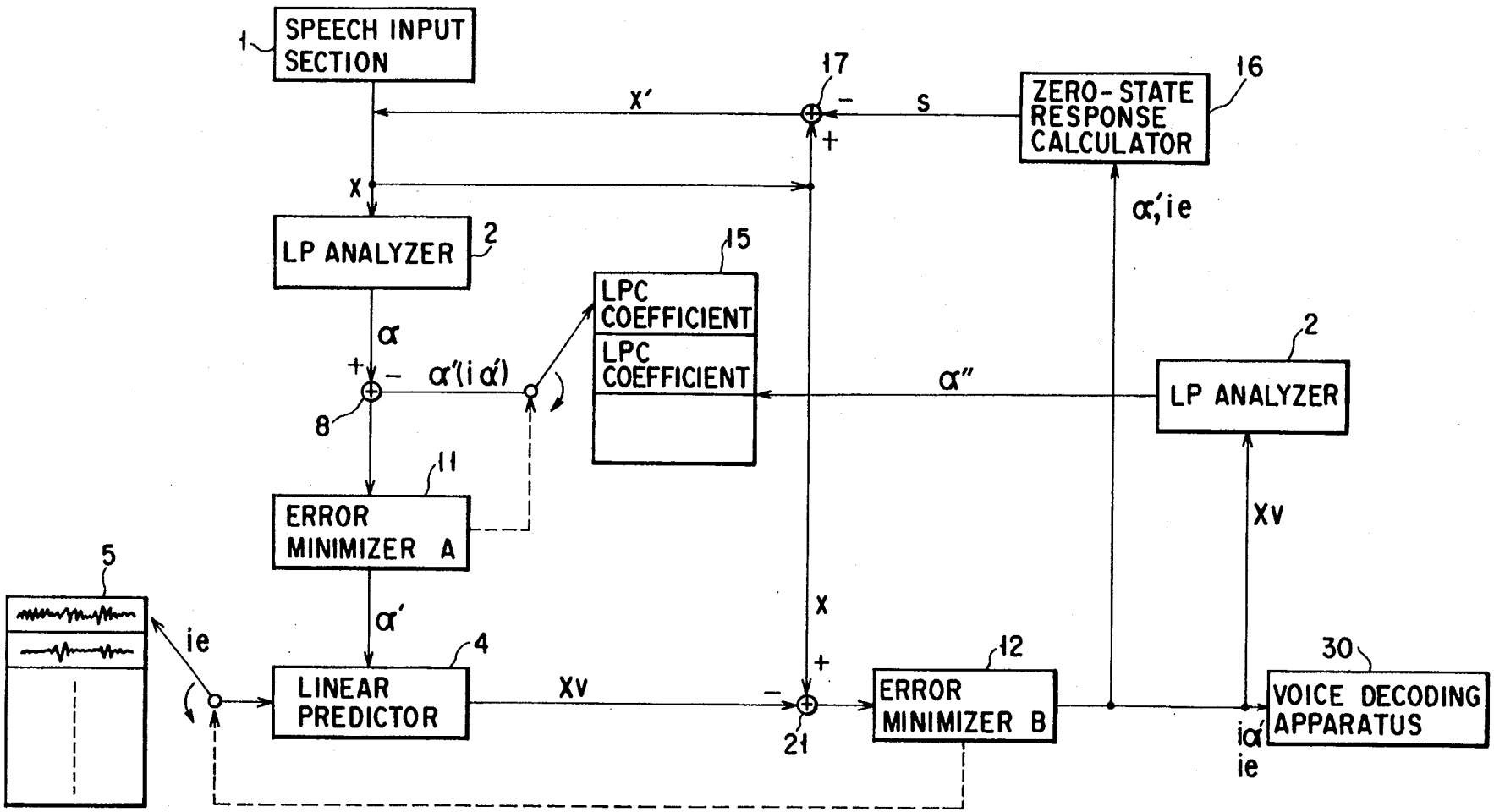
FIG. 10 is a diagram illustrating the structure of a third embodiment of this invention.

FIG. 10 illustrates the structure of a third embodiment of this invention. This embodiment is a combination of the first embodiment and the second embodiment which includes the zero-state response calculator.

In FIG. 10, the processing up to the acquisition of the predictive speech $x_v$ to minimize the error and the index $i_e$ of the excitation code book 5 by the error minimizer B12 is the same as the first embodiment. Thereafter, this index $i_e$ and the LP coefficient $\alpha'$ are sent to the zero-state response calculator 16 to compute the zero-state response S of the element vector of the excitation code book 5 which is specified by the index $i_e$. A new LP coefficient $\alpha$ is obtained again in the LP analyzer 2 based on the difference x' between the input speech x and the zero-state response S. That LP coefficient $\alpha'$ which is closest to this LP coefficient $\alpha$ is selected from the synthesized speech LPC code book 15. Although it is possible to immediately send the selected LP coefficient $\alpha'$ to the voice decoding apparatus 30, the index $i_e$ of the optimal excitation code book 5 is obtained again to improve the coding precision. The above processing is repeated until the LP coefficient $\alpha'$ does not vary any more. Then, the index i$\alpha'$ of the synthesized speech LPC code book 15 and the index $i_e$ of the excitation code book 5 are sent to the voice decoding apparatus 30 as mentioned earlier. The predictive speech $x_v$ for the minimum error is sent to the linear predictor 2 from the error minimizer B12 to be converted into the LP coefficient $\alpha''$ again. This LP coefficient $\alpha''$ is newly registered as an element of the synthesized speech LPC code book 15.

The quantization error can be minimized by computing the quantization error, which occurs in the excitation code book 5, by the zero-state response calculator 113 and subtracting it from the input speech in the above manner.

Figure 11:
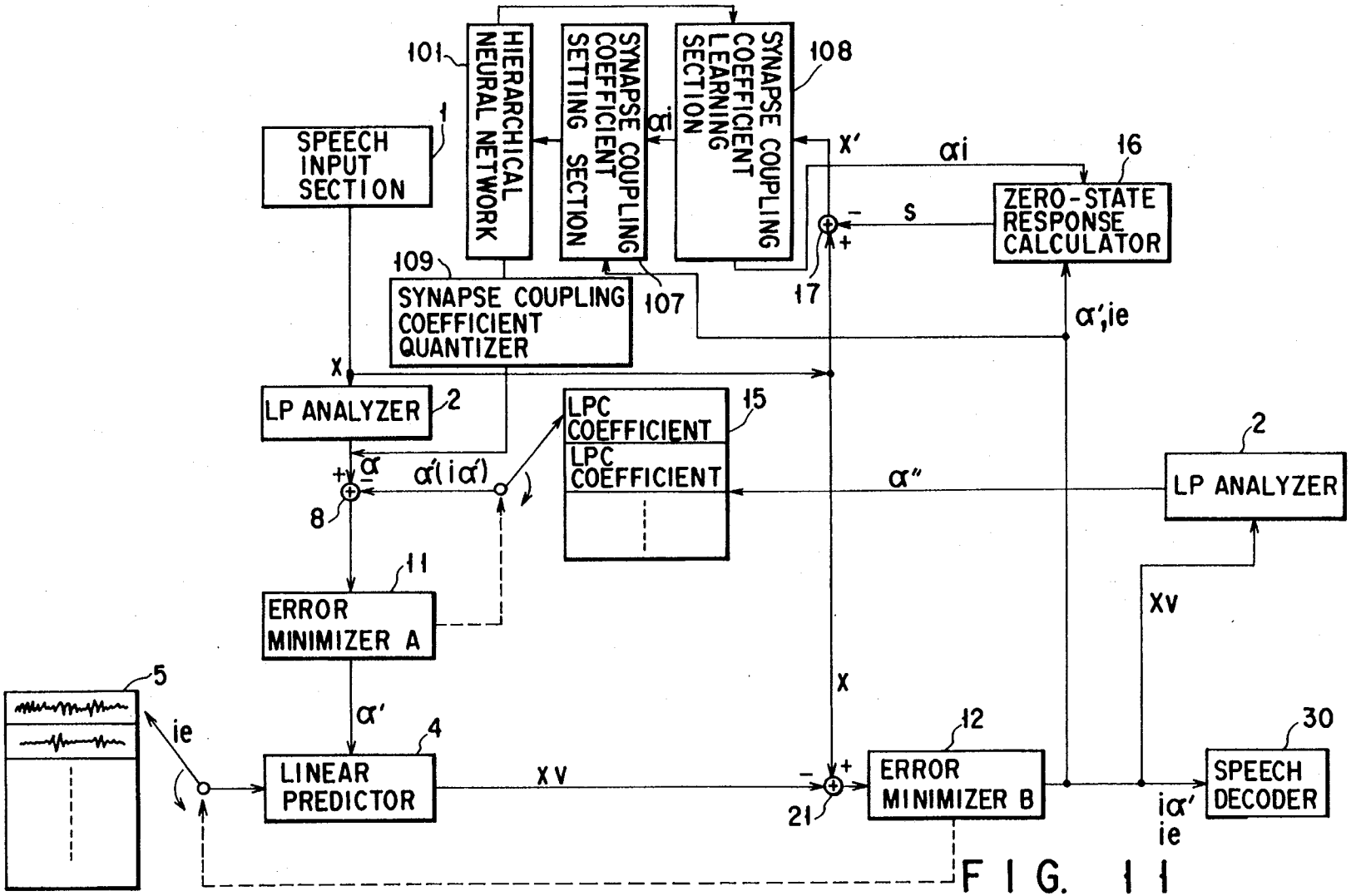
FIG. 11 is a diagram showing a modification of the third embodiment of this invention.

FIG. 11 shows a modification of the third embodiment of this invention. This modification is the embodiment shown in FIG. 10 to which the neural network portion of the second embodiment is added.

As the synapse coupling coefficient learning section 108, the synapse coupling coefficient setting section 107, the hierarchical neural network 101 and the synapse coupling coefficient quantizer 109, which constitute a neural network portion, are the same as those of the second embodiment, their description will not be given.

In the modification of FIG. 11, the LP coefficient acquired by the first embodiment is tuned for optimization by using the neural network. This modification therefore has an effect of preventing a reduction in the precision of the LP coefficient in addition to the effect of the embodiment of FIG. 10.

Figure 12:
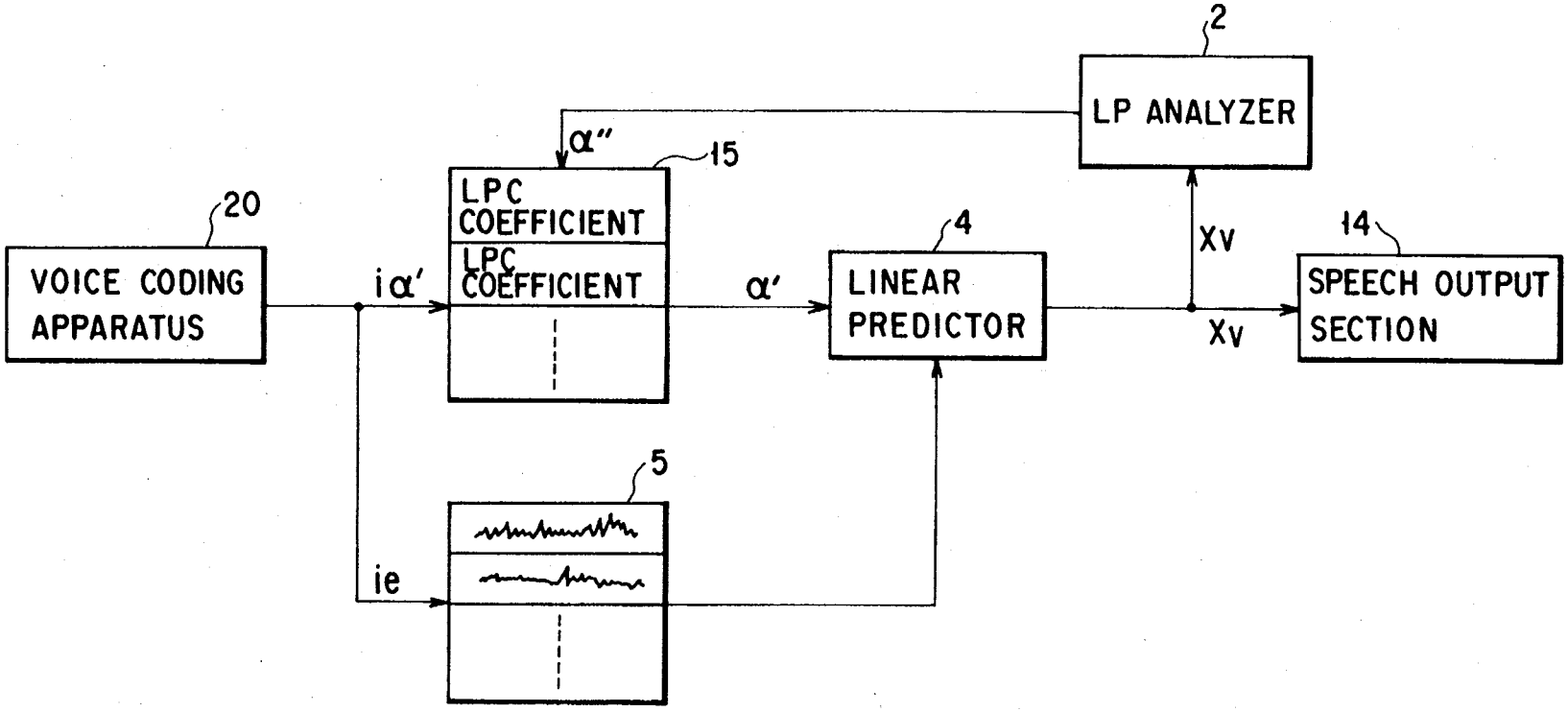
FIG. 12 is a diagram illustrating the structure of a voice decoding apparatus according to the first embodiment of this invention.
Figure 13:
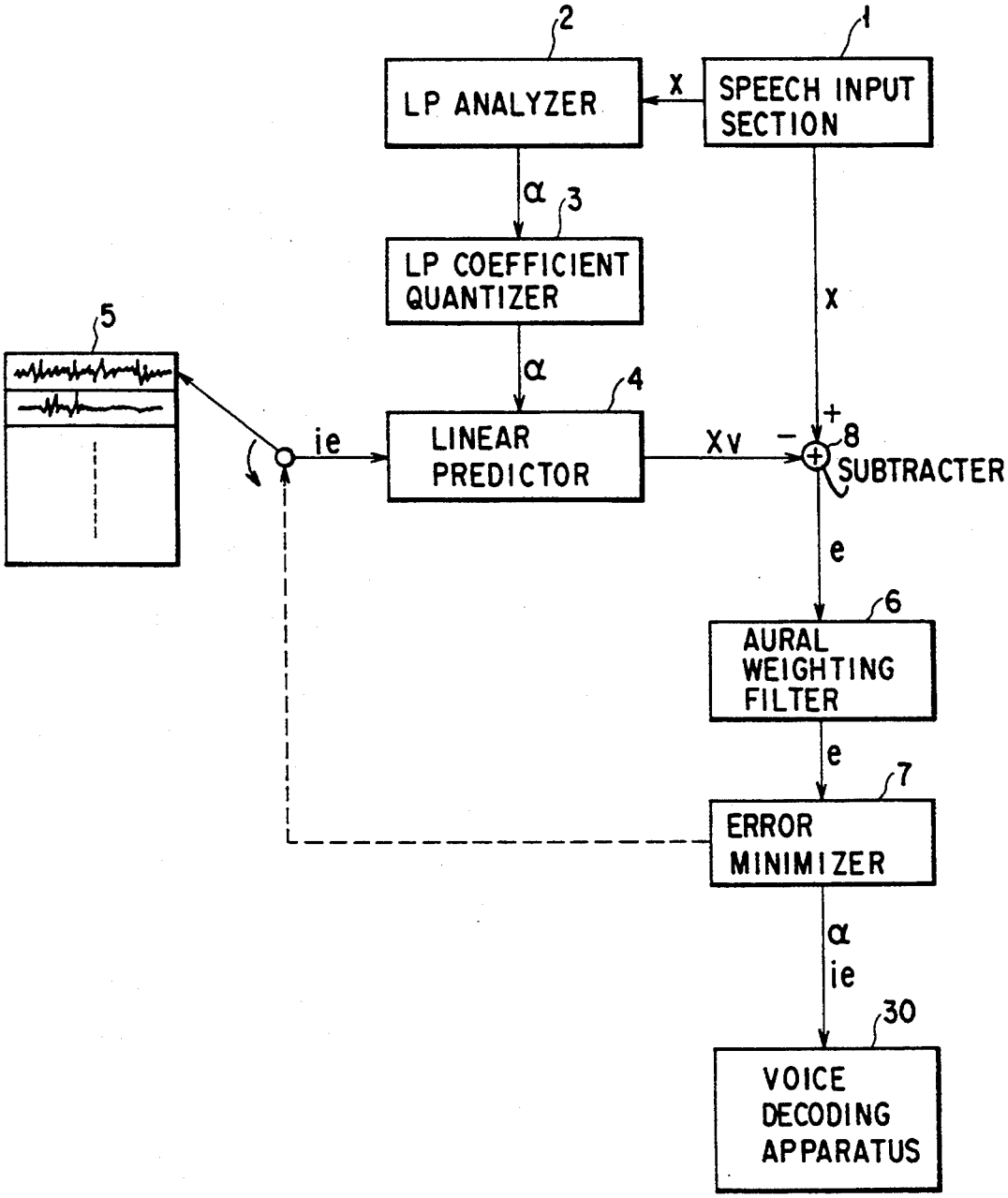
FIG. 13 is a diagram showing a conventional voice coding apparatus.

FIG. 12 illustrates an example of the voice decoding apparatus according to the first embodiment. An index $i\alpha'$ of the synthesized speech LPC code book 15 and an index $i_e$ of the excitation code book 5 are sent from the voice coding apparatus 20. First, an element (linear prediction coefficient) $\alpha'$ of the synthesized speech LPC code book 15, which is indicated by the index $i\alpha'$, and an element (excitation vector) of the excitation code book 5, which is indicated by the index $i_e$ are supplied to the linear predictor 4 to compute a synthesized speech $x_v$. This synthesized speech $x_v$ is sent to the linear predictor 2 to obtain the LP coefficient $\alpha''$ again, which is registered as an element of the synthesized speech LPC code book 15 as in the voice coding apparatus side. As this embodiment is equivalent to adaptive vector quantization of LP coefficients, this embodiment has a higher quantization efficiency than the conventional scalar quantization, .and LP coefficients are provided only inside the apparatus (i.e., the LP coefficients are not transmitted), thus ensuring sufficient large analysis order and quantization precision.

In short, the voice coding apparatus of the present invention utilizes the correlation (similarity) of a synthesized speech and an old synthesized speech, which has not been used in the prior art, to thereby ensure higher quality and lower bit rate.

Although three embodiments and some modifications have been described herein, the present invention is not limited to those but various other improvements and modifications can be made within the scope and spirit of the invention.

For instance, although the hierarchical neural network 101 used in the above embodiments is a double-layer linear type network, a non-linear neural network may be added between the input and output layers.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. A voice coding apparatus comprising:

first linear prediction analyzing means for producing linear prediction coefficients based on received input speech sampled at a given time interval;

code book means for storing linear prediction coefficients of speech resynthesized based on an old input speech;

excitation code book means for storing predetermined excitation vectors;

first subtracter means for performing a subtraction operation of the linear prediction coefficient from said first linear prediction analyzing means, for calculating an error between the linear prediction coefficient from said first linear prediction analyzing means and one of linear prediction coefficients in said coefficient code book means, and for producing an error output;

first error minimizing means for acquiring the linear prediction coefficient in said coefficient code book means which minimizes the error output of said first subtracter means, and its index;

linear predicting means for acquiring a synthesized speech based on the linear prediction coefficient obtained by said first error minimizing means and an excitation vector in said excitation code book means;

second error minimizing means for receiving a signal representing an error between said input speech and said synthesized speech, and for acquiring an index of the excitation vector in said excitation code book means which minimizes the error, and a synthesized speech; and second linear prediction analyzing means for receiving said synthesized speech from said second error minimizing means and for obtaining therefrom a linear prediction coefficient, and for supplying the obtained linear prediction coefficient to said coefficient code book means for storage of the obtained linear prediction coefficient in said coefficient code book means.

2. A voice coding apparatus according to claim 1, further comprising:

zero-sate response calculating means for receiving the linear prediction coefficient obtained by said first error minimizing means, and the index of the excitation vector obtained by said second error minimizing means, and for producing a zero-state response; and a second subtracter for calculating an error between said zero-state response and said input speech, and for supplying the calculated error to said first linear prediction analyzing means.

3. A voice coding apparatus according to claim 1, further comprising:

zero-sate response calculating means for receiving the linear prediction coefficient obtained by said first error minimizing means, and the index of the excitation vector obtained by said second error minimizing means, and for producing a zero-state response;

a second subtracter for calculating an error between said zero-state response and said input speech; and a neural network for setting said linear prediction coefficient obtained by said first error minimizing means as an initial value of a synapse coupling coefficient, for updating said linear prediction coefficient in response to an output from said second subtracter, and for outputting the updated coefficient to said first subtracter.

4. A voice coding apparatus according to claim 3, wherein said neural network includes a linear neuron unit.

5. A voice coding apparatus according to claim 3, wherein said neural network includes a linear neuron unit, and a non-linear neuron unit connected to said linear neuron unit.

6. A voice coding apparatus according to claim 5, further comprising random number generating means for providing an initial value of the synapse coupling coefficient between an input layer of said neural network and said non-linear neuron unit, and an initial value of the synapse coupling coefficient between said non-linear neuron unit and an output layer of said neural network.

7. A voice coding apparatus according to claim 3, further comprising gain adding means, arranged between said excitation code book and said linear prediction means, for providing a gain to said excitation vector from said excitation code book.

8. A voice coding apparatus according to claim 1, further comprising gain adding means, arranged between said excitation code book and said linear prediction means, for providing a gain to said excitation vector from said excitation code book.

9. A voice coding apparatus comprising:

means for receiving input speech and for sampling the input speech at a given time interval;

linear prediction analyzing means for acquiring a linear prediction coefficient based on the input speech sampled at the given time interval;

a neural network for setting said linear prediction coefficient from said linear prediction analyzing means as an initial value of a synapse coupling coefficient, for acquiring a synthesized signal of said input speech while updating said synapse coupling coefficient which represents an updated linear prediction coefficient, and for outputting the updated linear prediction coefficient at a point when an error between said synthesized signal and said input speech is minimized; [and]

wherein said neural network includes a linear neuron unit; and error calculating means for determining an error between said input speech and said synthesized signal of said input speech obtained from the updated linear prediction coefficient from said neural network, based on the updated linear prediction coefficient from said neural network and said input speech.

10. A voice coding apparatus according to claim 9, wherein said neural network further includes a non-linear neuron unit connected to said linear neuron unit.

11. A voice coding apparatus according to claim 10, further comprising random number generating means for providing an initial value of the synapse coupling coefficient between an input layer of said neural network and said non-linear neuron unit, and an initial value of the synapse coupling coefficient between said non-linear neuron unit and an output layer of said neural network.

12. A voice decoding apparatus comprising:

coefficient code book means for storing linear prediction coefficients and for receiving an index of linear prediction coefficients of a coding apparatus, and for outputting a linear prediction coefficient corresponding to a received index;

excitation code book means for receiving an index of an excitation vector of the coding apparatus, and for outputting an excitation vector corresponding to the index received by said excitation code book means;

linear prediction means for generating a synthesized speech based on said linear prediction coefficient output by said coefficient code book means, and said excitation vector output by said excitation code book means; and linear prediction analyzing means for producing a new linear prediction coefficient from said synthesized speech generated by said linear prediction means, and for supplying said new linear prediction coefficient to said coefficient code book means for storage in said coefficient code book means.

13. A voice coding/decoding apparatus comprising coding means and decoding means, and wherein:

said coding means includes:

first linear prediction analyzing means for producing linear prediction coefficients based on received input speech sampled at a given time interval;

coefficient code book means for storing linear prediction coefficients of speech synthesized based on an old input speech;

excitation code book means for storing predetermined excitation vectors;

first subtracter means for performing a subtraction operation of the linear prediction coefficient from said first linear prediction analyzing means, for calculating an error between the linear prediction coefficient from said first linear prediction analyzing means and one of linear prediction coefficients in said coefficient code book means, and for producing an error output;

first error minimizing means for acquiring the linear prediction coefficient in said coefficient code book means which minimizes the error output of said first subtracter means, and its index;

linear predicting means for acquiring a synthesized speech based on the linear prediction coefficient obtained by said first error minimizing means and an excitation vector in said excitation code book means;

second error minimizing means for receiving a signal representing an error between said input speech and said synthesized speech, and for acquiring an index of the excitation vector in said excitation code book means which minimizes the error, and a synthesized speech; and second linear prediction analyzing means for receiving said synthesized speech from said second error minimizing means and for obtaining therefrom a linear prediction coefficient, and for supplying the obtained linear prediction coefficient to said coefficient code book means for storage of the obtained linear prediction coefficient in said coefficient code book means; and said decoding means includes:

a further coefficient code book means for receiving an index of a coefficient code book of a coding means, and for outputting a linear prediction coefficient corresponding to the received index;

a further excitation code book means for receiving an index of an excitation vector of the coding means, and for outputting an excitation vector corresponding to the index received by said further excitation code book means;

a further linear prediction means for generating a synthesized speech based on said linear prediction coefficient output by said further coefficient code book means, and said excitation vector output by said further excitation code book means; and a further linear prediction analyzing means for producing a new linear prediction coefficient from said synthesized speech generated by said linear prediction means, and for supplying said new linear prediction coefficient to said further coefficient code book means for storage of said new linear prediction coefficient in said further coefficient code book means.

* * * * *